US006283807B1

(12) United States Patent
Kokubo et al.

(10) Patent No.: US 6,283,807 B1
(45) **Date of Patent: *Sep. 4, 2001**

(54) ANTI-SPLASH DEVICE FOR MARINE OUTBOARD DRIVE

(75) Inventors: Kouei Kokubo; Daisuke Nakamura; Akihiro Onoue; Noriyuki Natsume, all of Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/257,576

(22) Filed: Feb. 25, 1999

(30) Foreign Application Priority Data

Feb. 25, 1998 (JP) ..... 10-043494
Apr. 28, 1998 (JP) ..... 10-118606

(51) Int. Cl.[7] ..... B63H 21/36
(52) U.S. Cl. ..... 440/76
(58) Field of Search ..... 440/49, 76, 78, 440/66, 52, 53; 123/195 P

(56) References Cited

U.S. PATENT DOCUMENTS 4,781,634 * 11/1988 Harris et al. ..... 440/66
4,875,882 * 10/1989 Plitt et al. ..... 440/66
5,967,865 * 10/1999 Nakamura et al. ..... 440/52

* cited by examiner

*Primary Examiner*—S. Joseph Morano
*Assistant Examiner*—Andy Wright
(74) *Attorney, Agent, or Firm*—Knobbe, Martens, Olson & Bear, LLP

(57) ABSTRACT

A marine outboard drive, such as an outboard motor, includes both a splash plate and an anti-splash device. The anti-splash device includes a second splash plate that is provided on a lower mount, which couples together a swivel bracket and a drive housing. The second splash plate extends generally forwardly of the swivel bracket just under a lower portion of a clamp bracket that supports the swivel bracket. The anti-splash device preferably also includes a guide that is provided above the conventional splash plate for directing splashed water rearwardly so that the water is guided away from a mount cover that covers the lower mount. These features of the anti-splash device are particularly useful when the outboard drive is used with a pontoon boat.

27 Claims, 15 Drawing Sheets

ANTI-SPLASH DEVICE FOR MARINE OUTBOARD DRIVE

BACKGROUND OF THE INVENTION

1. Field of the Invention

This invention relates to an anti-splash device for a marine outboard drive and more particularly to an improved anti-splash device for an outboard drive that is the most suitable to, but not limited to, a pontoon.

2. Description of Related Art

Generally, a marine outboard drive, such as an outboard motor, is mounted on a transom board of a watercraft. FIG. 1 partially shows a conventional outboard motor 1 associated with a pontoon 2 that is a kind of watercraft. The outboard motor 1 comprises a power head 3 and a drive housing 4. The power head accommodates an engine (not shown) therein. The drive housing 4 comprises an upper housing 5 and a lower housing 6 and contains a drive shaft (not shown) that passes through the upper housing 5 and the lower housing 6. The drive shaft is powered by the engine and drives a propeller for thrusting the pontoon 2. A swivel bracket 7 is provided for supporting the drive housing 4 for pivotal movement about a vertically extending axis (not shown in FIG. 1). A clamp bracket 8 is affixed to a transom board 9 of a hull 10 and supports the swivel bracket 7 for pivotal movement about a horizontally extending axis 11.

The lower part of the drive housing 4 immerses in the water during cruising and splashes a mixture of water film and droplets in the upward direction from the surface of the water. In order to prevent splashed water 12 from impinging upon the upper portion of the drive housing 4, the lower housing 6 has a splash plate 13 extending generally forward (primarily forwardly and additionally laterally). In addition, a cavitation plate 14 is provided under the splash plate 13 for preventing cavitations from occurring.

The pontoon 2, as seen in FIGS. 2, 3 and 4, is lighter and its hull 10 generally consists of a bottom member 15 and a pair of floats 16, 17 that depend from the bottom member 15. Thus, the hull 10 has, in other words, a catamaran structure. Because of this structure, there is a relatively large space 18 between the bottom member 15 and the waterline 19. During cruising, accordingly, backwashes 20, 21 made by the floats 16, 17 affect each other, i.e., synchronize and amplify and then rise in the area indicated by the cross hatching 22. The splash plate 12 is not useful against the splash 23, 24 (FIG. 1) caused by such rises of waves.

In order to prevent the splashed water 23, 24 and 25, in some arrangement, as seen in FIG. 5, a water hampering plate 30 is mounted on the transom board 9, while a screen member 31 is mounted on a lower mount housing 40, which will be described later. This arrangement is disclosed in Japanese Provisional Publication 8-268385. The water hampering plate 30, however, is allowed to be provided on only a special watercraft. Also, streams of water that impinge the water hampering plate 30 give rise a force that raises the stern of the pontoon 2 and jeopardize one of the most remarkable features of the pontoon 2 that its position hardly changes during cruising. In addition, such protrusions of the water hampering plate 30 from the hull 10 and also the screen member 31 from the drive housing 4 are likely to harm appearances of a watercraft and a marine outboard drive and eventually reduce their value in sale.

It is, therefore, a principle object of this invention to provide an improved anti-splash device that can effectively prevent splashed water from impinging upon an associated watercraft.

It is a further object of this invention to provide an anti-splash device that will not jeopardize the feature of a pontoon that its position hardly changes during cruising.

It is a still further object of this invention to provide an anti-splash device that will not harm appearances of a watercraft nor a marine outboard drive.

In addition, as seen in FIGS. 5 and 6, the swivel bracket 7 supports the drive housing 4 with an upper mount (not shown) and lower mount that is identified generally by the reference numeral 41. The lower mount 41 basically comprises the lower mount housing 40 a bolt 42, a rubber mount 43 and a nut 44. The lower mount housing 40 is incorporated with the swivel bracket 7 while the rubber mount 43 is incorporated with the drive housing 4 and both of them are fastened with the bolt 42 and the nut 44. A mount cover 45 is provided for covering the mount rubber 43. This mount cover is used not only for covering the mount rubber 43 but also for keeping the rubber mount body 43 in a secured position. The mount cover 45 has a slit 46 on its side through which a tool such as a screwdriver is permitted to pass. The tool is necessary to push the bolt 42 against the lower mount housing 40 when they are tightly joined together. Due to the purpose, the slit 46 is relatively large. Thus, its appearance is not aesthetically pleasing and water is likely to enter through the slit and become trapped within the mounting cover.

It is, therefore, a yet further object to provide an improved mount structure that keeps good appearance of a marine outboard drive and requires no further opening for discharging trapped water.

SUMMARY OF THE INVENTION

One feature of this invention is adapted to be embodied in a marine outboard drive having a drive housing through which drive means of the marine outboard drive passes. A swivel bracket is provided for supporting the drive housing with mounting means for pivotal movement about a vertically extending axis. A clamp bracket is affixed to a hull of an associated watercraft and supports the swivel bracket for pivotal movement about a horizontally extends axis. An anti-splash device comprises a splash plate provided on the mounting means and extending generally forwardly of the swivel bracket.

Another feature of this invention is adapted to be embodied in a marine outboard drive having a drive housing through which drive means of the marine outboard drive passes. A swivel bracket is provided for supporting the drive housing with mounting means for pivotal movement about a vertically extending axis. A clamp bracket is affixed to a hull of an associated watercraft and supports the swivel bracket for pivotal movement about a horizontally extending axis. An anti-splash device comprises a guide means for guiding splashed water rearwardly.

An additional feature of this invention is adapted to be embodied in a marine outboard drive having a drive housing through which drive means of the marine outboard drive passes. A swivel bracket is provided for supporting the drive housing for pivotal movement about a vertically extending axis with at least an upper mount and a lower mount. Both of the mounts have a first connecting member on the swivel bracket and a second connecting member on the drive housing. The second connecting member is covered with a mount cover. A clamp bracket is affixed to a hull of an associated watercraft and supports the swivel bracket for pivotal movement about a horizontally extending axis. The mount cover is provided with at least one opening at the bottom thereof.

DETAILED DESCRIPTION OF THE PREFERRED EMBODIMENTS OF THE INVENTION

First Embodiment (FIGS. 7 through 22)

Figure 1:
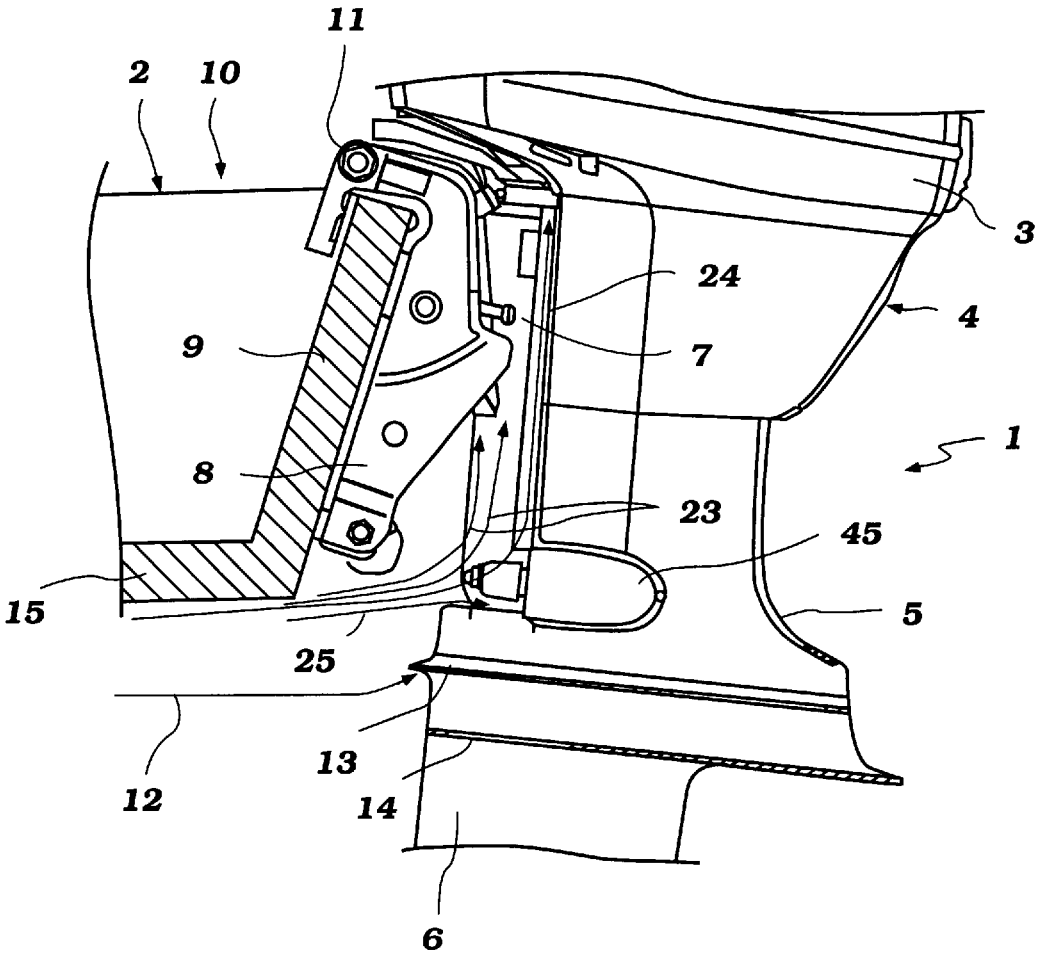
Figure 1 Prior Art
FIG. 1 is a side elevational view showing a part of a conventional outboard motor as attached to an associated pontoon.
Figure 2:
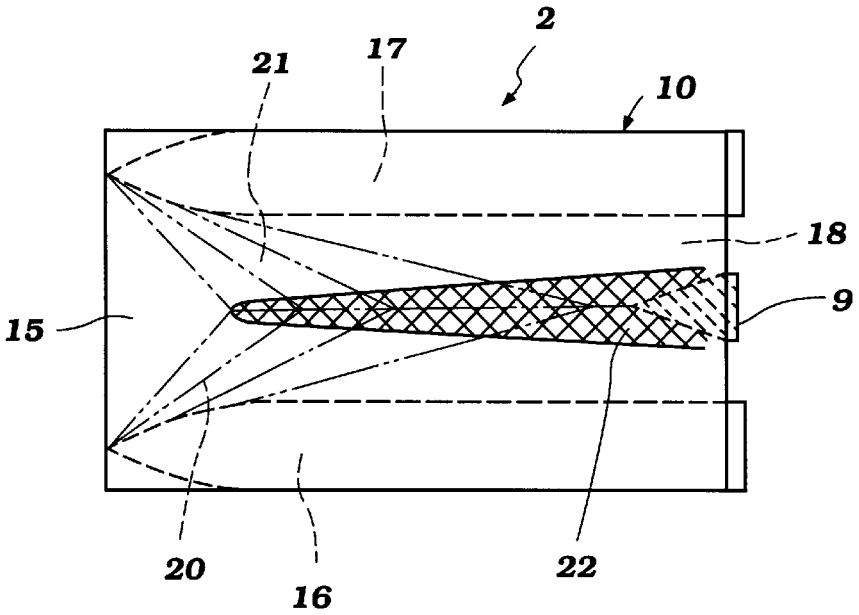
FIG. 2 is a schematic plan view of the pontoon.
Figure 3:
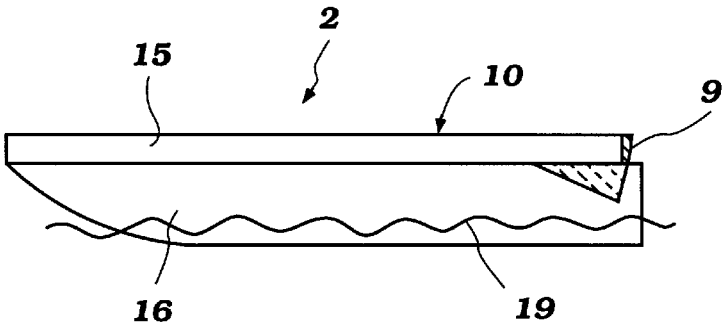
FIG. 3 is a schematic side view of the pontoon.
Figure 4:
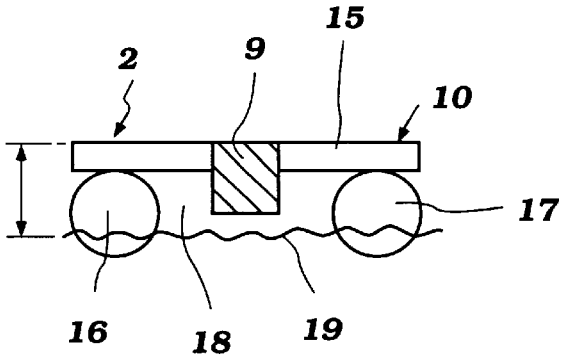
FIG. 4 is a schematic rear view of the pontoon.
Figure 5:
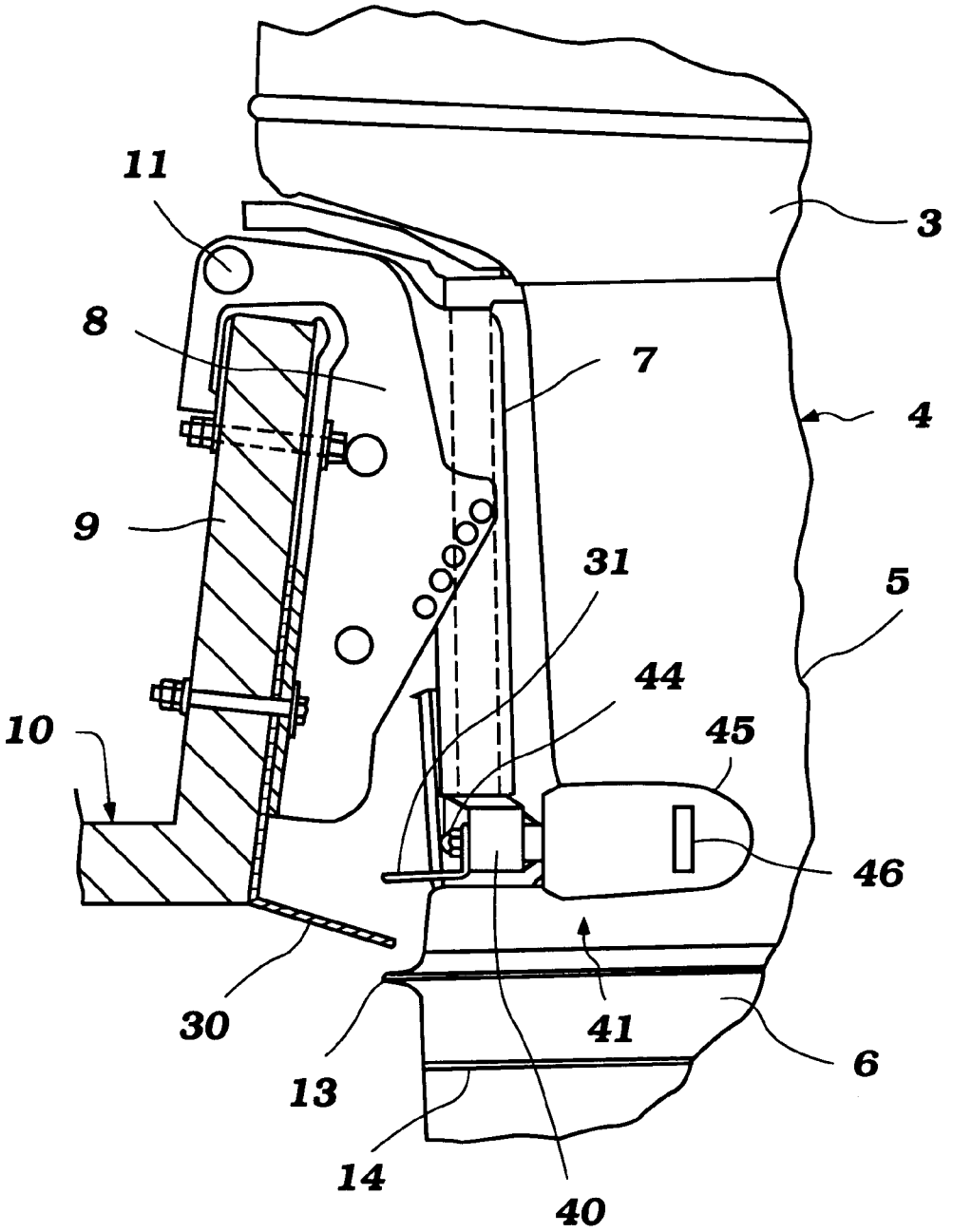
FIG. 5 is a side elevational view showing a part of another conventional outboard motor as attached to another associated pontoon.
Figure 6:
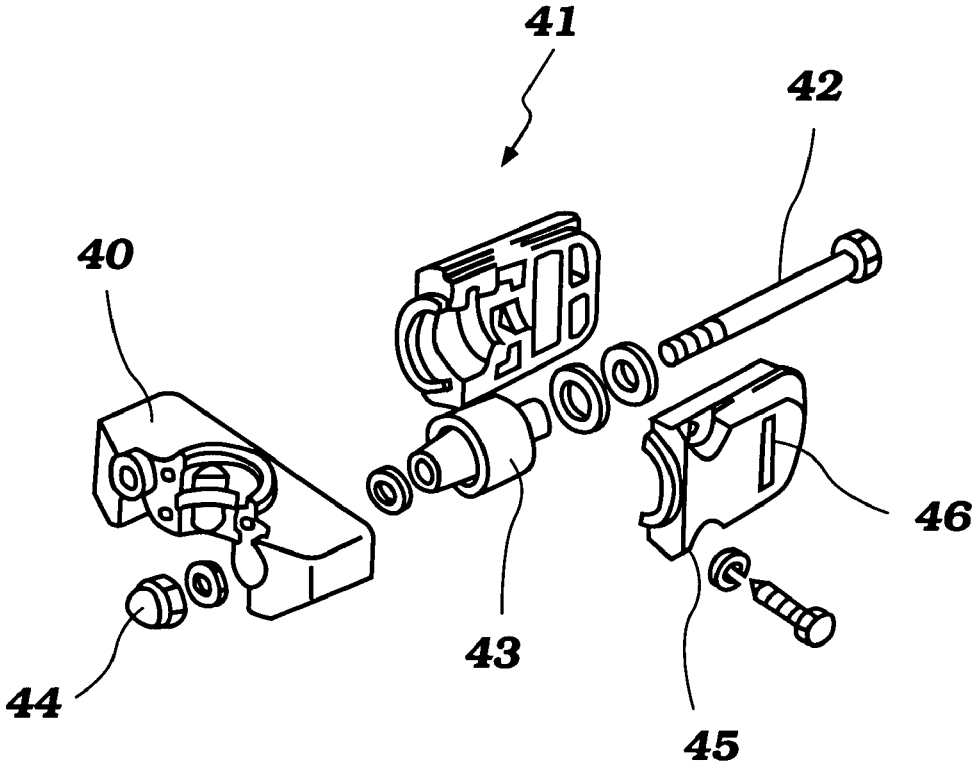
FIG. 6 is a perspective view of a conventional lower mount.

One preferred embodiment of this invention will now be described with reference to FIGS. 7 through 22. The same components and parts already described in connection with the conventional arrangements shown in FIGS. 1 through 6 have the same reference numerals so as to avoid repetition.

FIGS. 7 through 11 illustrate a general arrangement of an outboard motor 1 that incorporates the features of this invention and an associated pontoon 2.

A tilt assembly 50 is provided between a swivel bracket 7 and a clamp bracket 8. The tilt assembly 50 consists of a cylinder 51 connected to the clamp bracket 8 with a pivotally connecting member 52 at its bottom end, a piston (not shown) that reciprocates along the cylinder axis and a piston rod 53 that is connected to the piston and also the swivel bracket 7 with another pivotally connecting member 54 at the top end of the piston rod 53. Thus, the clamp bracket 8 supports the swivel bracket 7 that holds a drive housing 4 (upper housing) for pivotal movement about the horizontally extending axis 11. In order to tilt up or tilt down the drive housing 4, a hydraulic system comprising a hydraulic motor 55, a hydraulic pump 56 and a switch valve 57 are provided. The hydraulic motor 55 drives the hydraulic pump 56.

The swivel bracket 7, on the other hand, supports the drive housing 4 for pivotal movement about a vertically extending axis 58. Since the vertically extending axis 58 is a steering shaft, the drive housing 4 can be steered. The top of the steering shaft 58 is connected to a pair of axes 60 of upper mount assemblies 61 that are affixed to the upper housing 5, while the bottom of the steering shaft 58 is connected to a pair of lower mount housings 62 of lower mount assemblies 63 that are also affixed to the upper housing 5.

Figure 15:
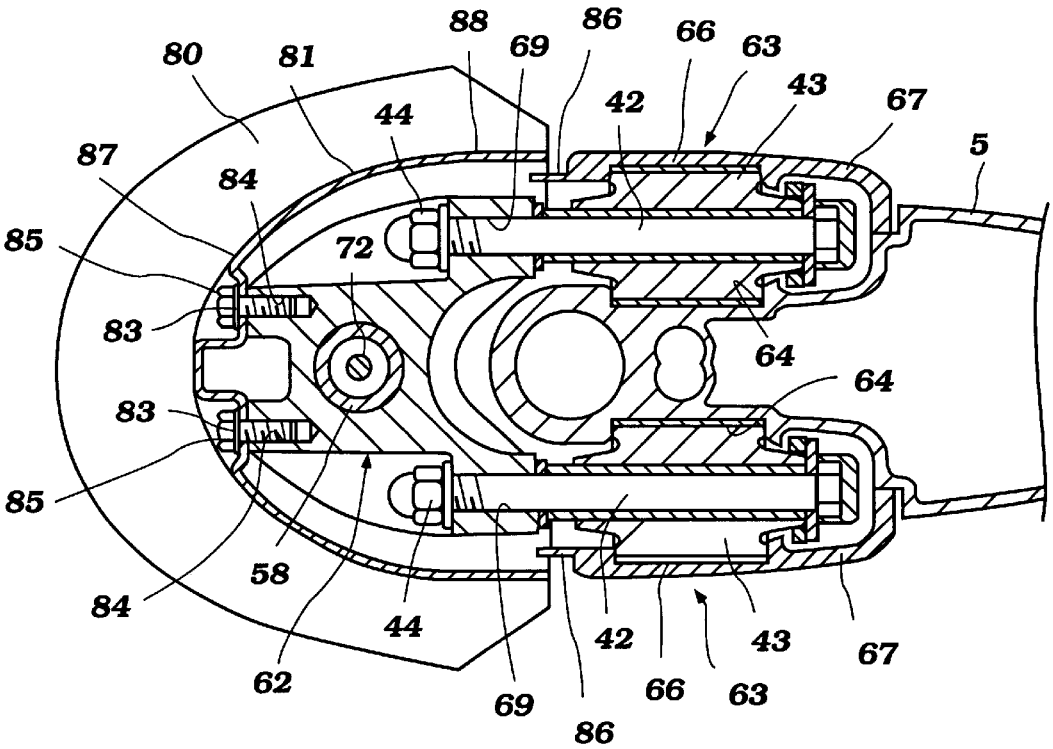
FIG. 15 is a cross sectional view taken along the line 15—15 in FIG. 12.

More specifically describing the lower connection, as best seen in FIG. 15, a pair of semi-cylindrical hollows 64 are formed in a guide exhaust 65 (the bottom and front part of the upper housing 5) and individual lower mount assemblies 63 are fitted into the hollows 64. The lower mount assembly 63 consists of a bolt 42, a mount rubber 43 surrounding a rear part of the bolt 42 and a mount sleeve 66 further surrounding the mount rubber 43. Mount covers 67 are affixed to the upper housing 5 with several bolts 68 to cover the lower mount assemblies 63 and keep the lower mount assembly 63 in a certain position. The lower mount housing 62 has a pair of openings 69 that allow each bolt 42 of the lower mount assemblies 63 to pass through. After the lower mount housing 62 is combined with the lower mount assemblies 63, box nuts 44 are fastened with the bolts 42.

The lower mount housing 62 has a serrated opening 70 at its almost center portion. Meanwhile, the bottom 71 of the steering shaft 58 is serrated that cooperates with the serrated opening 70. Accordingly, by inserting the steering shaft 58 into the opening 70, the steering shaft 58 is affixed to the lower mount housing 62 and eventually the swivel bracket 7 is also affixed to the upper housing 5. The steering shaft 58 is a tube and a shift shaft 72 passes through the steering shaft 58.

Since the upper connection between the upper housing 5 and the swivel bracket 7 is quite similar to the lower connection, a further description on it will be omitted.

Figure 7:
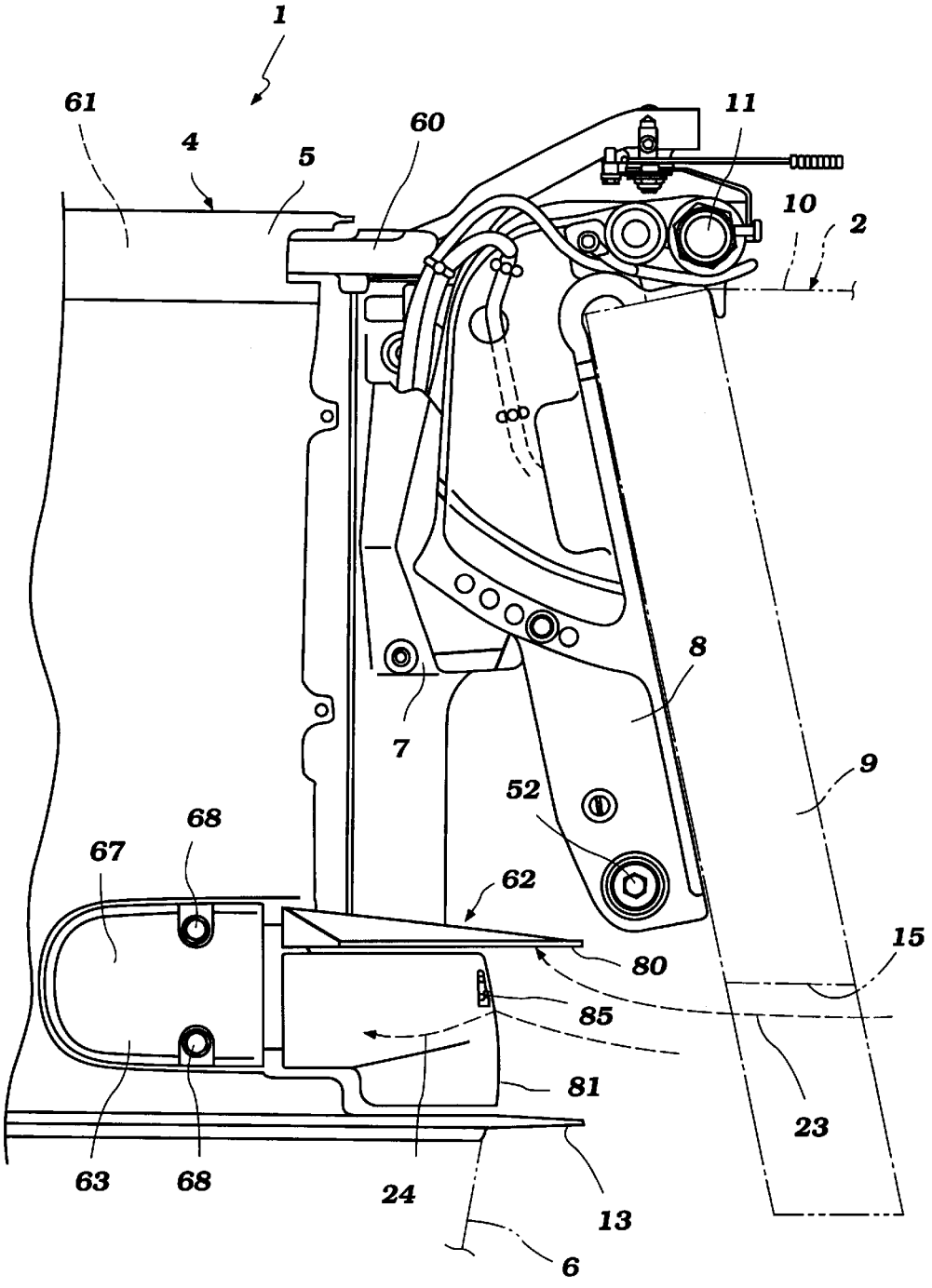
FIG. 7 is a side view showing a part of an outboard motor of this invention as attached to the pontoon.
Figure 8:
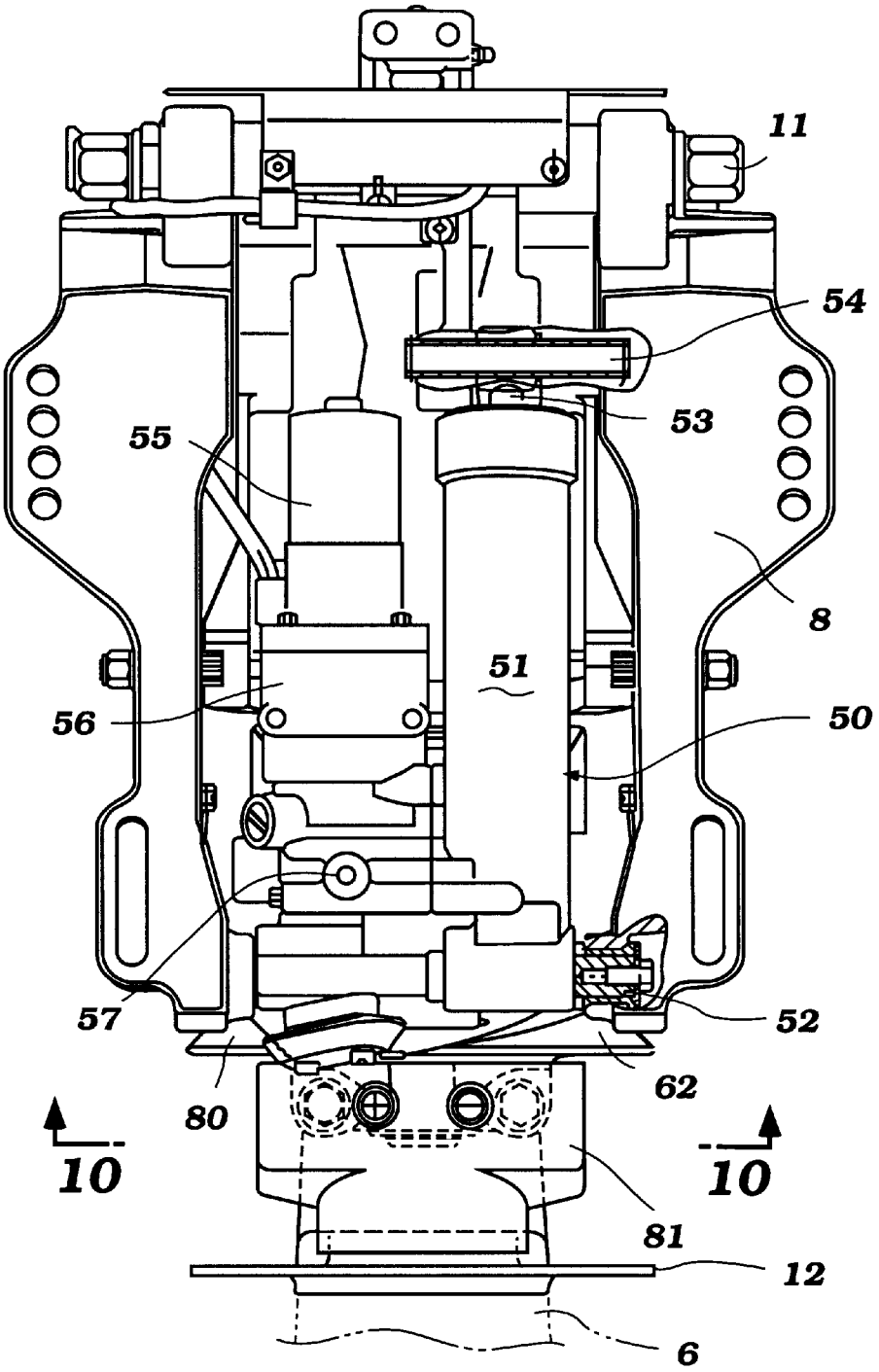
FIG. 8 is a front view of the outboard motor and showing a clamping and tilting mechanism of the drive housing in detail.
Figure 9:
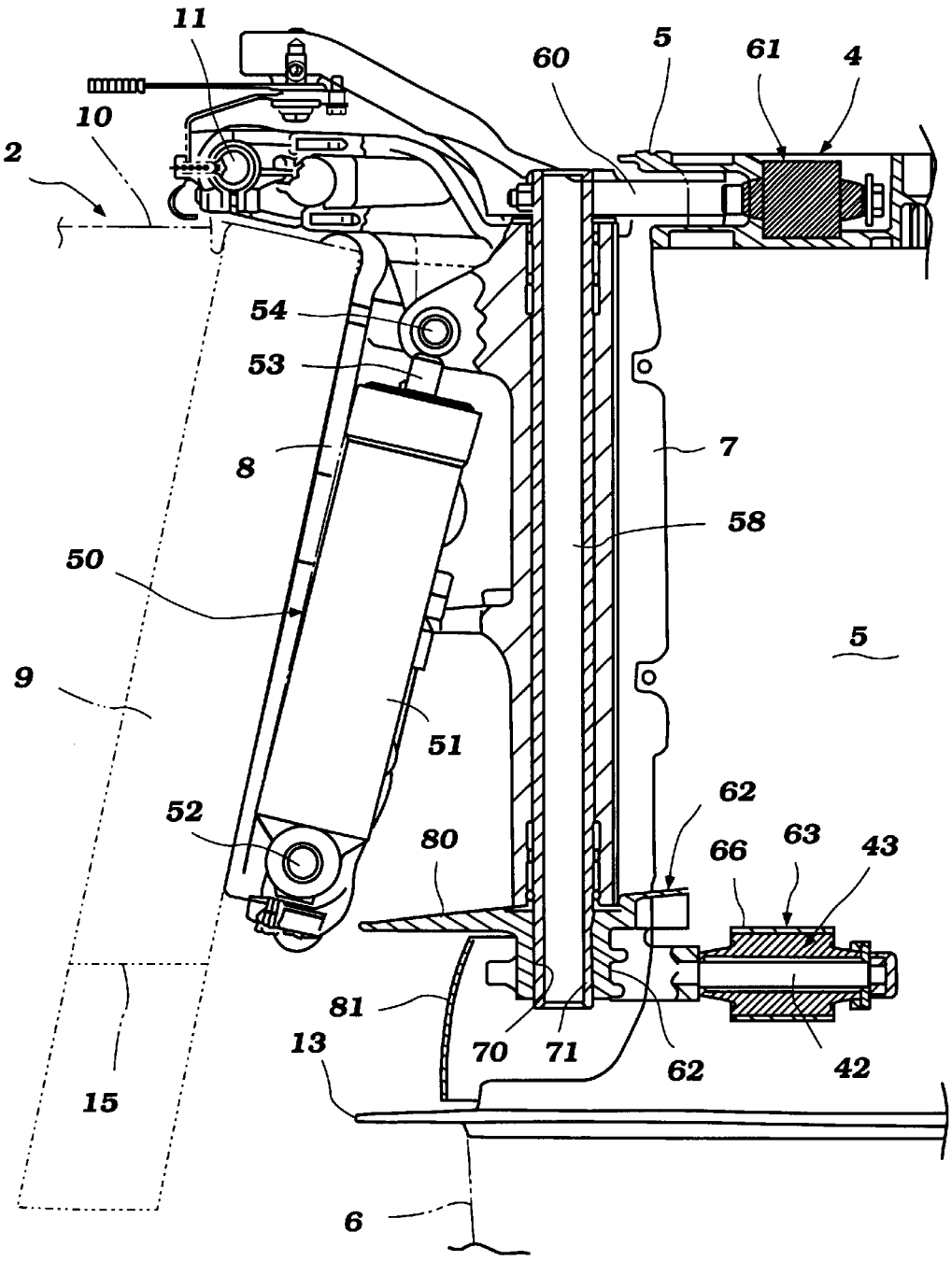
FIG. 9 is a side view showing another side of the outboard motor partially in section.
Figure 10:
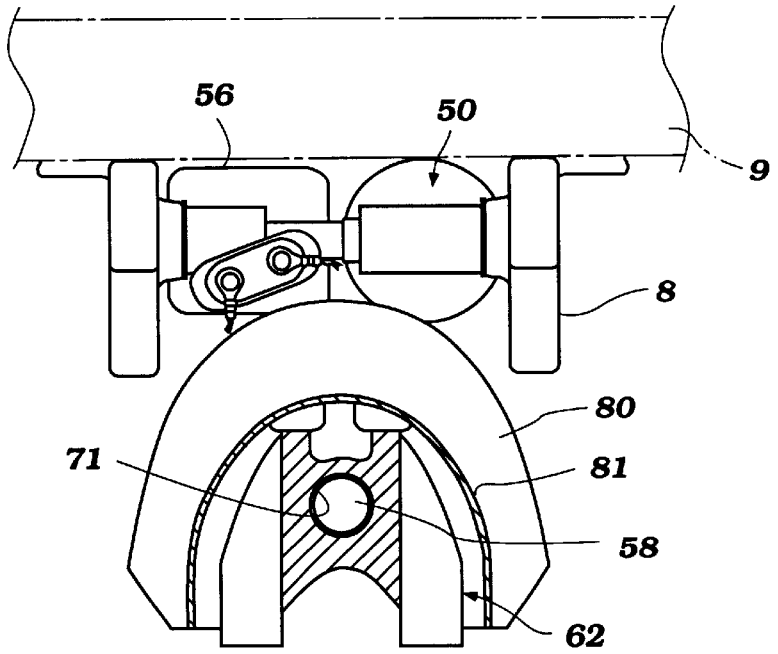
FIG. 10 is a cross sectional view taken along the line 10—10 in FIG. 8.
Figure 11:
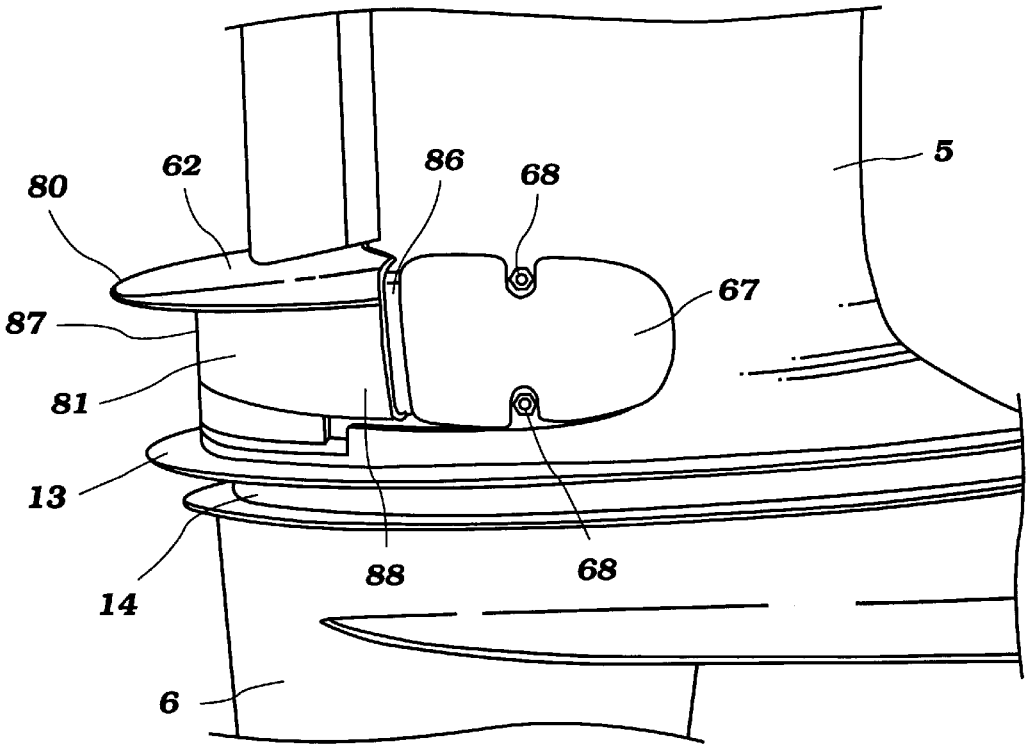
FIG. 11 is a perspective view of the outboard motor and showing particularly an anti-splash device of this invention.
Figure 12:
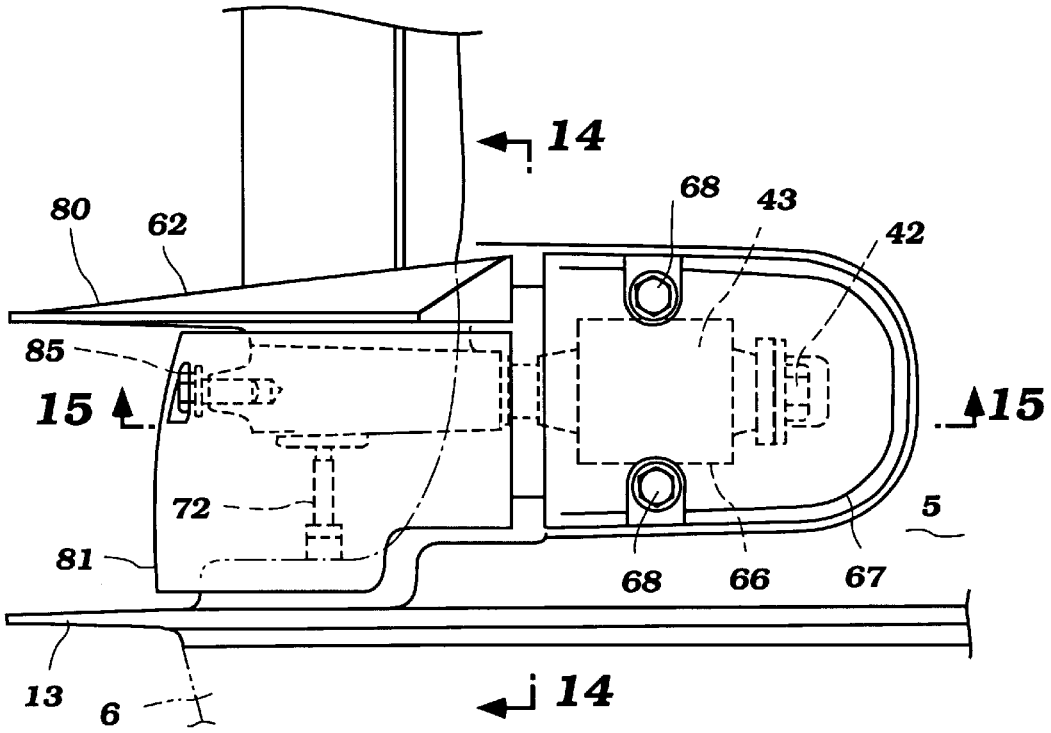
FIG. 12 is an enlarged side view of the anti-splash device.
Figure 13:
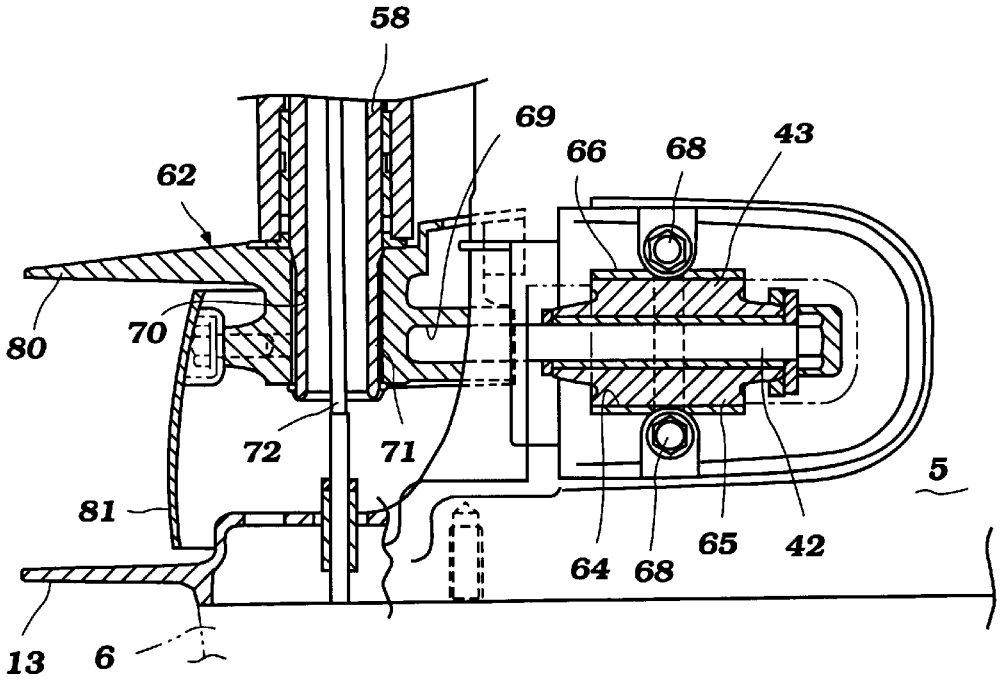
FIG. 13 is a cross sectional side view of the same anti-splash device.
Figure 14:
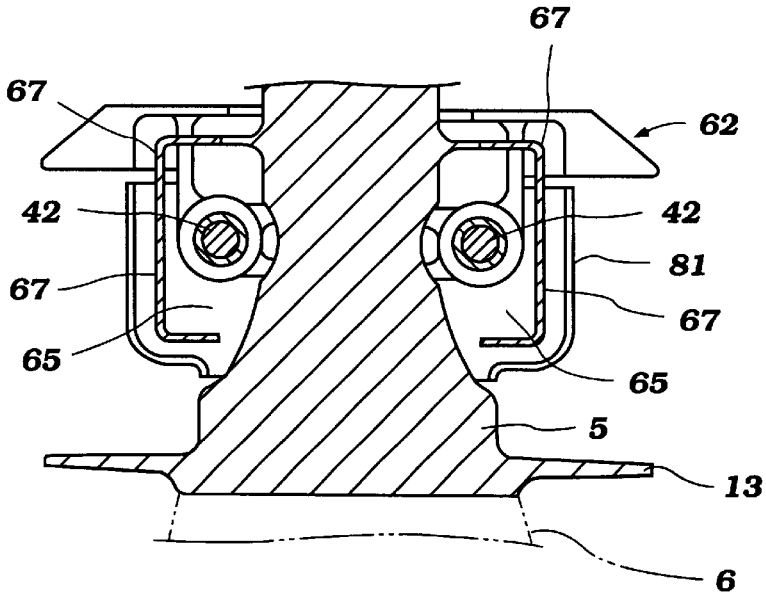
FIG. 14 is a cross sectional view taken along the line 14—14 in FIG. 12.

As described in connection with the conventional arrangement, the lower housing 6 has a splash plate 13. In this embodiment, another splash plate 80 that is integrated with the lower mount housing 62 is also provided. The upper splash plate 80 has almost the same shape of the lower splash plate 13 and extends generally forwardly (primarily forwardly and additionally laterally). The bottom face of the upper splash plate 80 is flat and its top face gently slopes. As seen in FIGS. 7 and 9, the upper splash plate 80 extends to the vicinity of the transom board 9 of the associated pontoon 2 and placed at almost the same level of the bottom 15, preferably slightly upper than the bottom 15 of the pontoon 2.

Figure 16:
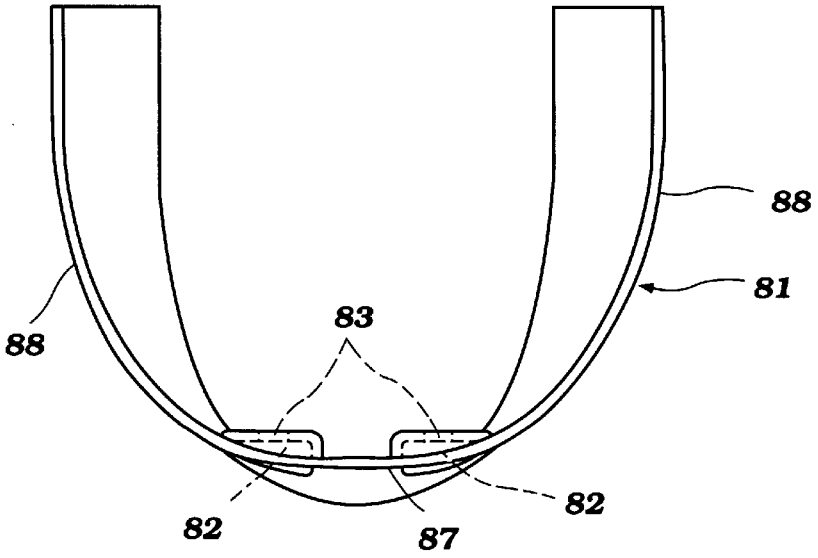
FIG. 16 is a plan view of an upper housing cover (cover means).
Figure 17:
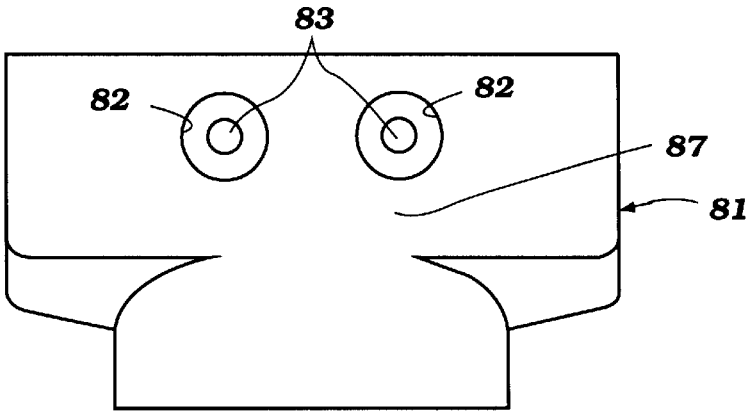
FIG. 17 is a front view of the upper housing cover.
Figure 18:
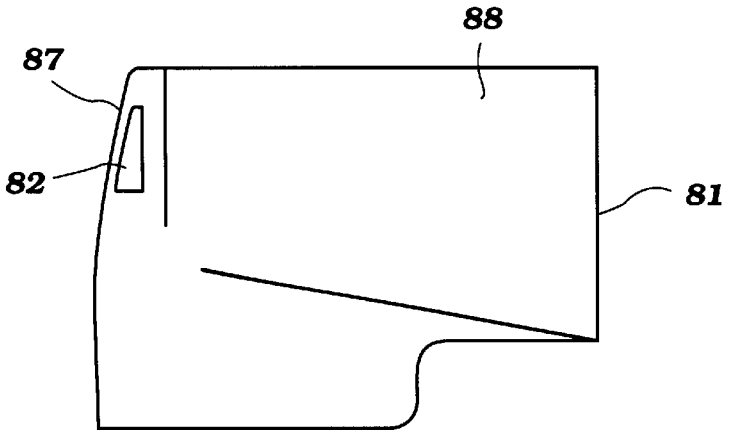
FIG. 18 is a side view of the upper housing cover.
Figure 19:
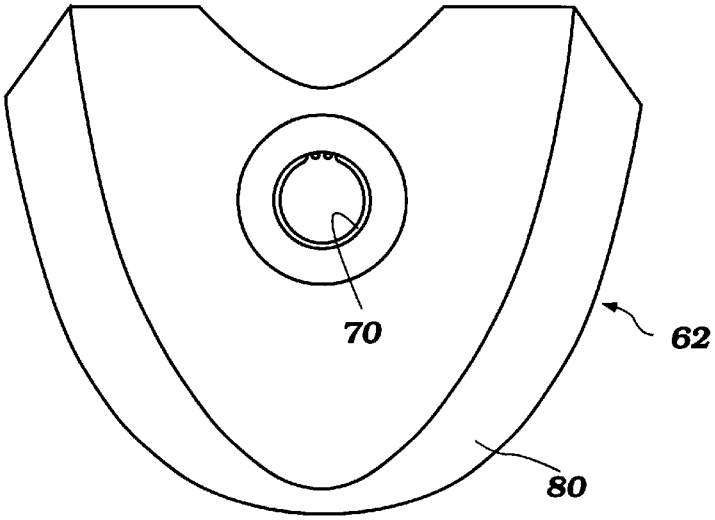
FIG. 19 is a plan view of a lower mount housing.
Figure 20:
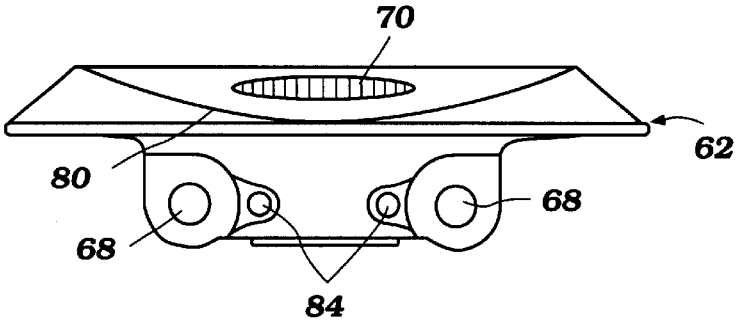
FIG. 20 is a front view of the lower mount housing.
Figure 21:
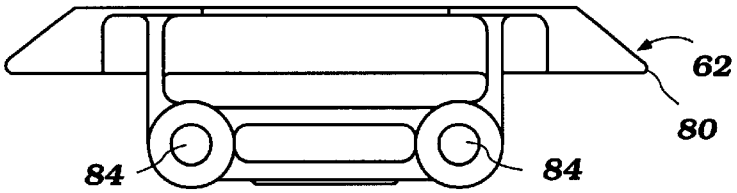
FIG. 21 is a rear view of the lower mount housing.
Figure 22:
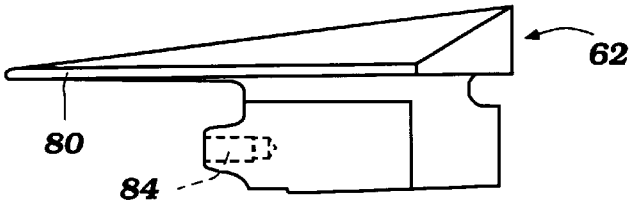
FIG. 22 is a side view of the lower mount housing.

A U-shaped upper housing cover 81 is provided for covering the upper housing 5 between the lower splash plate 13 and the upper splash plate 80. As best seen in FIGS. 16, 17 and 18, the front end of the housing cover 81 has a pair of recesses 82 and both of the recesses 82 have apertures 83. The recesses 82 can shelter heads of bolts described hereunder. As seen in FIGS. 20, 21 and 22, on the other hand, a pair of threaded grooves 84 are provided at the front end of the lower mount housing 62. The upper housing cover 81 is affixed on the lower mount housing 62 with bolts 85 (see FIG. 15).

The housing cover 81 that has the shape as described may cover roughness that is formed by the box nuts 44, steps of the lower mount housing 62 and other assembled components. Also, as best seen in FIG. 15, the front ends 86 of the mount covers 67 are thinner than the remaining portions. The rear end of the housing cover 81 is, thus, slightly overlapped with these front ends 86. As a result, individual outer faces of the housing cover 81 and the lower mount housing 62 both range smoothly with each other.

Further, both of the lower lateral ends of the upper housing cover 81 are formed also to range smoothly with the top outer face of the lower housing 6 that is above than the lower splash plate 13. That is, the front portion 87 of the housing cover 81 is slightly deeply drawn than its rear portion 88.

As described above, the splash plate 80 is placed above than the splash plate 13. Because of this, the upper splash plate 13 blocks the splashed water 23 that came from the backwashes 20, 21 (see FIG. 2). Further, since the upper splash plate 80 is not attached to the hull 10, the excellent feature of a pontoon that its position hardly changes during cruising is apparently not jeopardized and the appearance of a watercraft, including the pontoon, is not harmed.

In addition, since the splash plate 80 extends to the vicinity of the transom board 9, it blocks the splashed water 23 going upwardly. The other positioning wherein the splash plate 80 is at almost the same level of the bottom 15 (preferably slightly upper position) also contributes the effect.

Further, the upper housing cover 81 can catch the splashed water 24 and guide it to smoothly flow away laterally and then rearwardly. The upper housing cover 81 also enhances the appearance of the marine outboard drive 1.

Figure 23:
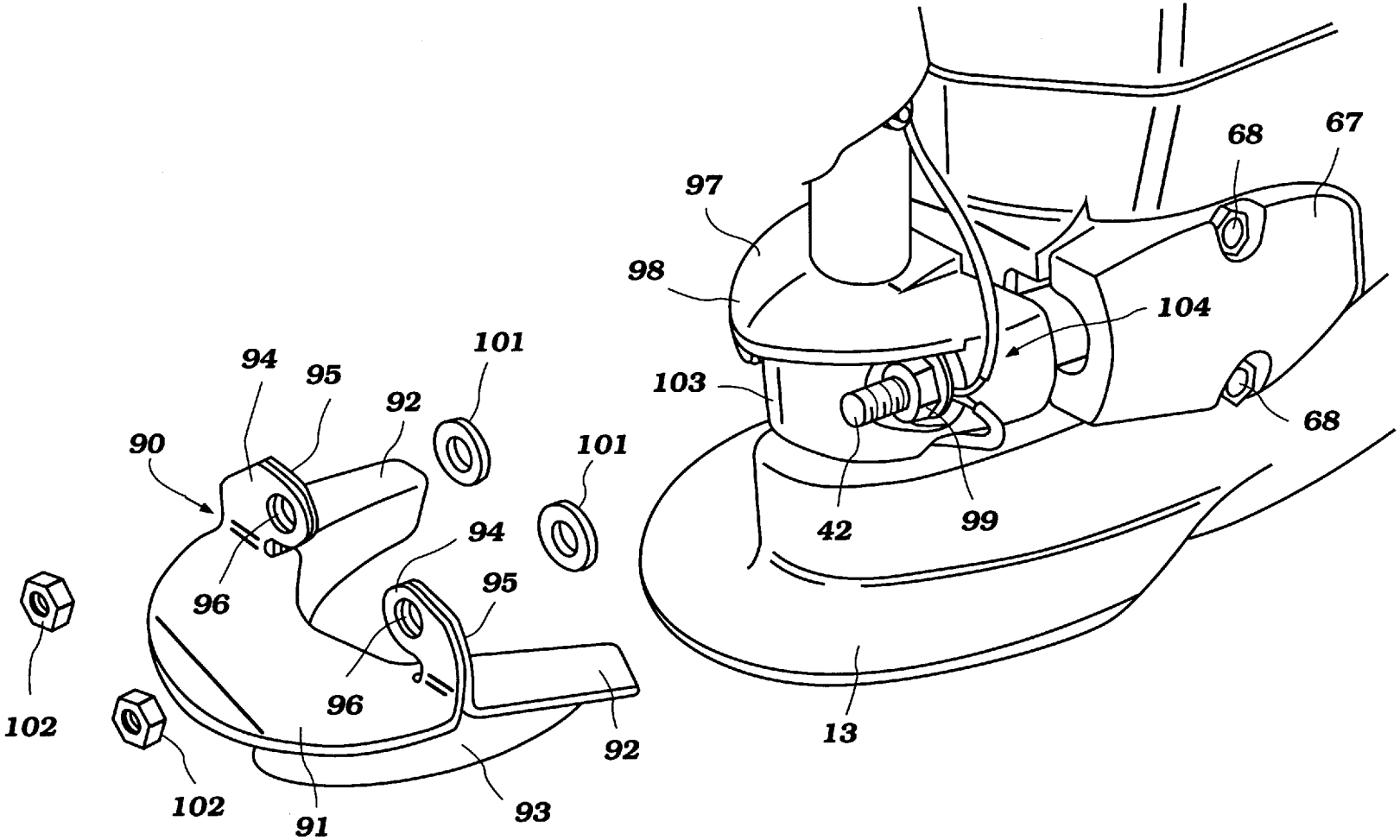
FIG. 23 is a perspective view of another anti-splash device of this invention and showing a condition of before assembly.
Figure 24:
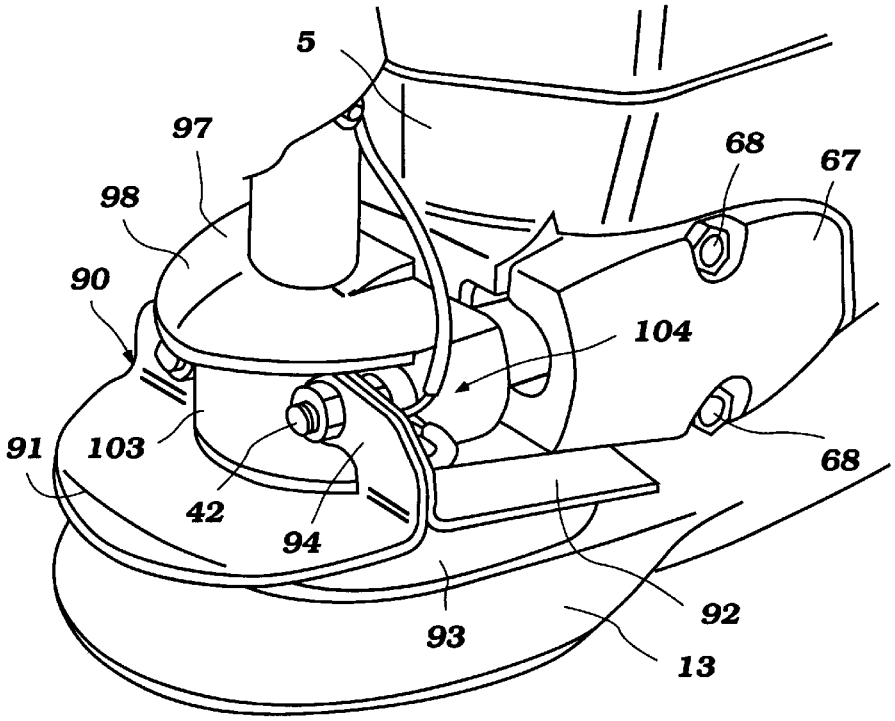
FIG. 24 is a perspective view of the anti-splash device and showing the condition of after assembly.
Figure 25:
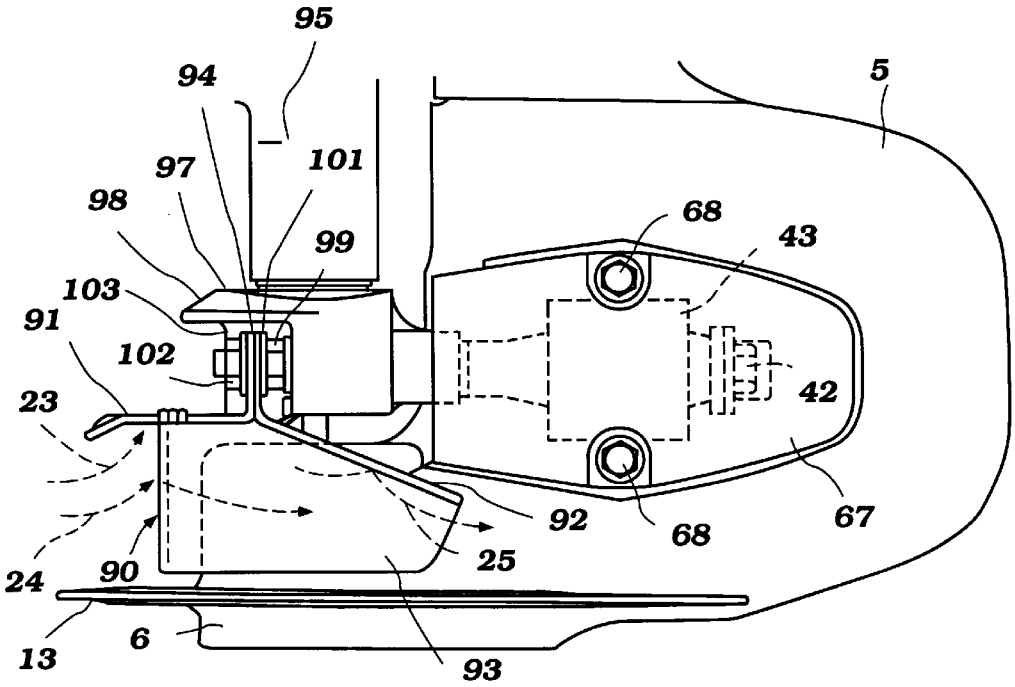
FIG. 25 is a side view of the anti splash device and showing the condition of after assembly.

Second Embodiment (FIGS. 23 through 25)

With reference to FIGS. 23, 24 and 25, another preferable embodiment will be described hereunder. The same components and parts already described in connection with the conventional arrangements shown in FIGS. 1 through 6 and the first embodiment shown in FIGS. 7 through 22 have the same reference numerals so as to avoid repetition.

In this embodiment, generally, a guide unit 90 replaces the upper housing cover 81 in the first embodiment. The guide unit 90 is made of aluminum sheet metal that is caulked and then coated. More specifically, the guide unit 90 consists of three parts in general. The first part is a splash plate 91 extending forwardly and its front end is slightly bent down. The second part is a pair of guide members 92 extending rearwardly and downwardly and finishing under the front bottom of the mount cover 67. The third part is a cover member 93 covering the front of the upper housing 5 between the middle splash plate 91 and the lower splash plate 13. This cover member 93 has almost the same curved surface as the upper housing cover 81 described in the first embodiment. The middle splash plate 91 has a pair of flanges 94, while the guide members 92 have flanges 95 that oppose the flanges 94. The flanges 94 of the middle splash plate 91 and the flanges 95 of the guide members 92 are jointed by caulking. Meanwhile, the top end of the cover member 93 is also jointed with both of the bottom ends of the middle splash plate 91 and the guide members 92 by caulking. The guide unit 90, thus, is one integrated component. The caulked up flanges 94, 95 have openings 96 that allow bolts described hereunder to pass through.

The lower mount housing 97 in this embodiment has a relatively small splash plate 98 extending forwardly. The lower mount housing 97 is attached to the bolts 42 and fastened with nuts 99 so that the lower mount housing 97 is eventually fixed to the upper housing 5. The guide unit 90 is further affixed to the bolts 42. That is, the bolts 42, as well as the washer 101, are inserted into the openings 96 of the guide unit 90 and then fastened up with nuts 102. In this embodiment, an anti-galvanic arrangement 104 is provided, as seen in FIGS. 23 and 24.

It should be noted that the guide unit 90 is used as an optional component because it is detachable from the bolts 42.

In the arrangement of this second embodiment, the front end 103 of the lower mount housing 97 is not covered with the guide unit 90 and exposures to splashes. However, splashed waters are nearly blocked by the lower splash plate 13 and the middle splash plate 91. That is, the splashed water 23 is blocked with the middle splash plate 91. Splashed water 24 impinges the cover member 93 and then flows away laterally and rearwardly. Further, the splashed water 25 impinges the guide member 92 and then flows away also.

Thus, all of the splashed waters 23, 24 and 25 finally flow away rearwardly. In this regard, since the guide members 92 go under the mount covers 67, no splashed water impinges on the mount covers 67 and bypasses the mount cover 67 and then flow away quite smoothly. If some splashes go over the middle splash plate 91, then the upper splash plate 98 prevents them from going up further.

The arrangement in this second embodiment brings almost the same advantages as described in connection with the first embodiment.

Improvement of Mount Cover

Figure 26:
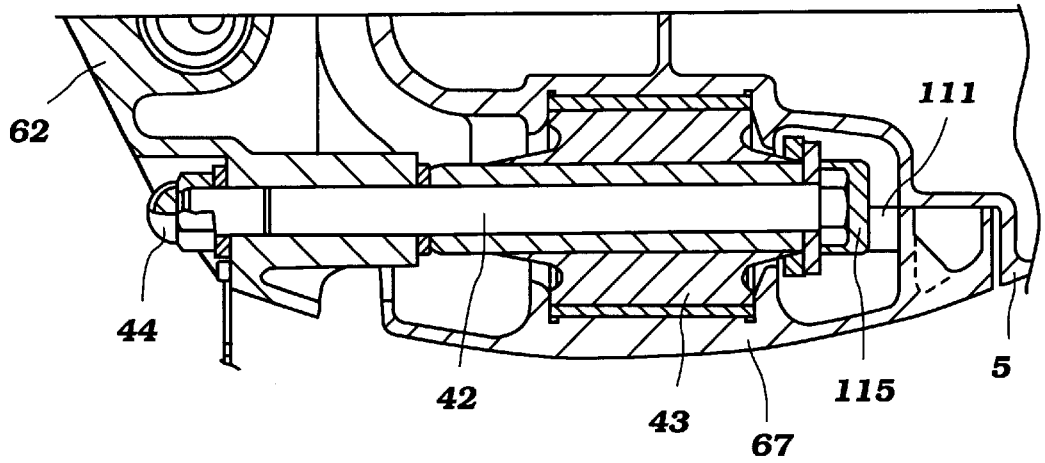
FIG. 26 is a cross sectional plan view of a lower mount and particularly showing a mount cover.
Figure 27:
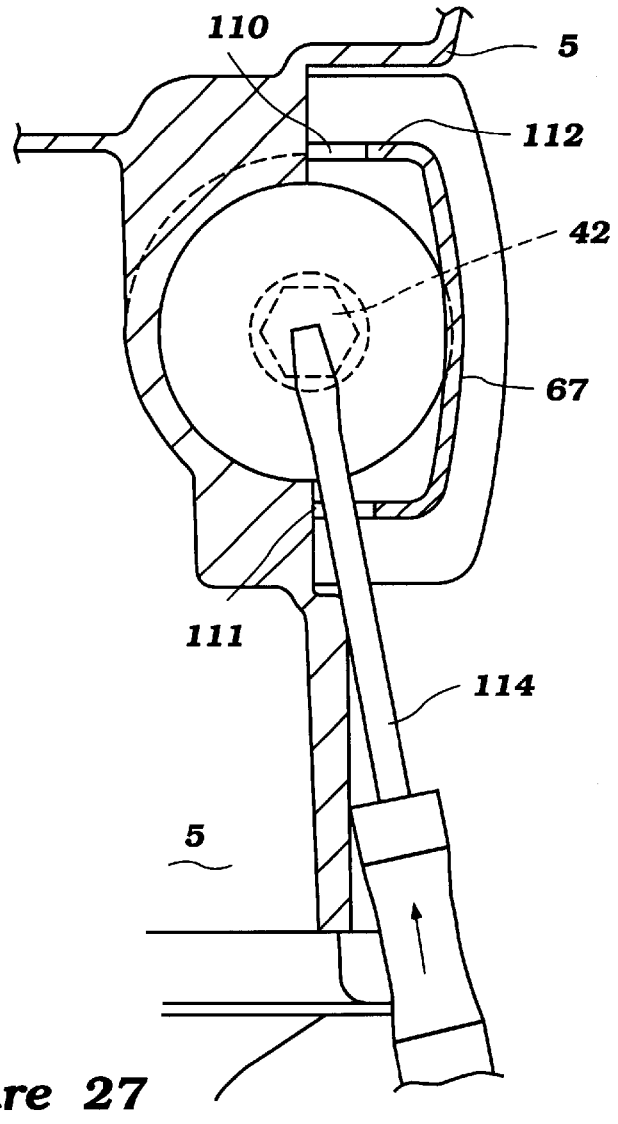
FIG. 27 is a cross sectional rear view of the lower mount and particularly showing a situation wherein a screwdriver is inserted inside of the mount cover.

As seen in FIGS. 26 and 27, an upper opening 110 and a lower opening 111 are provided at opposed positions of the top wall 112 and the bottom wall 113 of the mount cover 67. A tool such as a screwdriver is allowed to pass the openings 110, 111.

As described in connection with the conventional arrangement, after the mount cover 67 is affixed to the upper housing 5, the nuts 44 need to be fastened with the bolts 42. In this fastening process, a screwdriver 114 is necessary to push the bolt 42 against the lower mount housing 62. The lower opening 111 is used for this purpose and the screwdriver 114 is inserted through the lower opening 111. Thus, the fastening operation of the nut 44 can be easily done. An elastic cover 115 is put on the head of the bolt 42 for a more easy operation.

In addition, the trapped water in the mount cover 67 is drawn out because the opening 111 is opened at the bottom wall 113.

The upper opening 110 is not useful in fastening the nuts 44 or discharging trapped water. However, because of the upper opening 110, the mount cover 67 is now interchangeable in being affixed to either side of the upper housing 5.

In summary, as described above, splashed water can be blocked by the upper, middle and/or lower splash plates and/or guided by the upper housing cover or the guide unit and flows away smoothly rearwardly.

Since no arrangements on an associated watercraft for hampering water are needed, appearances of the associated watercrafts will not be harmed. In addition, because of the housing cover or the guide unit that may cover roughness, appearances of the marine outboard drive is not harmed also.

Further, if the watercraft is a pontoon, its excellent feature that its position hardly changes during cruising is not jeopardized because no components or parts for hampering water are necessary on the stem of the pontoon.

In addition, since the mount cover has the lower opening at its bottom wall, the lower mount structure may keep good appearance and no further opening for discharging trapped water is required.

It should be noted that the associated watercraft is not limited to a pontoon and this invention is also useful for a catamaran except for the pontoon.

Of course, the foregoing description is that of preferred embodiments of the invention, and various changes and modifications may be made without departing from the spirit and scope of the invention, as defined by the appended claims.

What is claimed is:

1. A marine outboard drive comprising a drive housing through which at least a portion of a drive train of the marine outboard drive passes, a swivel bracket supporting the drive housing for pivotal movement about a generally vertically extending axis, at least one mount attaching the swivel bracket to the drive housing, a clamp bracket adapted to be affixed to a hull of an associated watercraft and supporting the swivel bracket for pivotal movement about a generally horizontal extending axis, a splash plate extending generally forwardly, and the splash plate being provided on the mount.

2. The marine outboard drive as set forth in claim 1 additionally comprising a second splash plate extending generally forward and placed lower than the first splash plate.

3. The marine outboard drive as set forth in claim 2 additionally comprising cover means for covering the drive housing between the first and second splash plates.

4. The marine outboard drive as set forth in claim 1, wherein the splash plate is unified with the mount.

5. The marine outboard drive as set forth in claim 1 additionally comprising a second mount positioned above the at least one mount.

6. The outboard motor drive as set forth in claim 1, wherein the splash plate is adapted to be placed at almost the same level of the bottom of an associated watercraft.

7. The outboard motor drive as set forth in claim 1, wherein the splash plate is adapted to be placed slightly above the bottom of an associated watercraft.

8. The outboard motor drive as set forth in claim 1, wherein the splash plate has a sufficient size so as to extend to the vicinity of an associated watercraft.

9. The outboard motor drive as set forth in claim 1 in combination with a pontoon watercraft.

10. The marine outboard drive as set forth in claim 1, wherein the splash plate is positioned generally lower than a lower end of the clamp bracket.

11. The marine outboard drive as set forth in claim 1 additionally comprising means for covering the mount, and the splash plate being positioned above the covering means.

12. The marine outboard drive as set forth in claim 11, wherein the covering means include a first part covering, generally a forward portion of the mount and a second part covering generally a side portion of the mount.

13. The marine outboard drive as set forth in claim 12, wherein the first part and the second part are separately formed.

14. The marine outboard drive as set forth in claim 11, wherein the covering means are arranged to direct the splash water rearwardly.

15. The marine outboard drive as set forth in claim 1 additionally comprising means for diverting splash water from the mount, and at least a portion of the diverting means being disposed generally in front of the mount.

16. The marine outboard drive as set forth in claim 15, wherein the splash plate is positioned above the diverting means.

17. The marine outboard drive as set forth in claim 16, wherein the diverting means include a second splash plate and a guide plate, and the splash water, in part, is blocked by the second splash plate and guided by the guide plate so as to be diverted from the mount.

18. The marine outboard drive as set forth in claim 17, wherein the diverting means additionally include a cover plate that covers the drive housing.

19. The marine outboard drive as set forth in claim 18, wherein the second plate, the guide plate and the cover plate are unified.

20. The marine outboard drive as set forth in claim 16 further comprising a second splash plate positioned below the diverting means.

21. The marine outboard drive as set forth in claim 20, wherein the diverting means include a third splash plate.

22. A marine outboard drive comprising a drive housing through which at least a portion of a drive train of the marine outboard drive passes, a swivel bracket supporting the drive housing for pivotal movement about a generally vertically extending axis, at least one mount attaching the swivel bracket to the drive housing, a clamp bracket adapted to be affixed to a hull of an associated watercraft and supporting the swivel bracket for pivotal movement about a generally horizontal extending axis, a first splash plate positioned generally upper than an upper portion of the mount, a second splash plate positioned generally lower than a lower portion of the mount, and means for covering at least a portion of the mount existing between the first and second splash plates.

23. A marine outboard drive comprising a drive housing through which at least a portion of a drive train of the marine outboard drive passes, a swivel bracket supporting the drive housing for pivotal movement about a generally vertically extending axis, at least one mount attaching the swivel bracket to the drive housing, a clamp bracket adapted to be affixed to a hull of an associated watercraft and supporting the swivel bracket for pivotal movement about a generally horizontally extending axis, and a cover member covering the mount, the cover member including at least one opening at a bottom thereof, the opening being configured to allow access to an interior of the cover member when the cover member covers the mount.

24. The marine outboard drive as set forth in claim 23, wherein the cover member includes a bottom wall which is shaped to fit around an outer contour of the mount, the at least one opening being provided in the lower wall and sized to allow trapped water within the cover to be drawn out.

25. The marine outboard drive as set forth in claim 24, wherein the cover member includes an upper wall shaped to fit around an outer contour of the housing and having a second opening.

26. The marine outboard drive as set forth in claim 23, wherein the at least one opening is sized to allow a tool to extend therethrough when the cover is connected to the housing.

27. The marine outboard drive as set forth in claim 26, wherein the tool is a screwdriver.

* * * * *

UNITED STATES PATENT AND TRADEMARK OFFICE

CERTIFICATE OF CORRECTION

PATENT NO. : 6,283,807 B1
DATED : September 4, 2001
INVENTOR(S) : Kouei Kokubo, Daisuke Nakamura, Akihiro Onoue and Noriyuki Natsume It is certified that error appears in the above-identified patent and that said Letters Patent is hereby corrected as shown below:

Title page,

References Cited, U.S. PATENT DOCUMENTS, please add the following:

-- 4,323,355 04/1982 Kondo.....440/76; 440/900
4,507,090 03/1985 Kobayashi et al.....440/52; 248/640
5,219,306 06/1993 Takahashi.....440/52; 248-640
5,511,997 04/1996 Yoshida.....440/52;248/635;248/640;248/643
5,549,492 08/1996 Yamamoto et al.....440/53; 440/76
5,799,925 09/1998 Kumita et al.....440/900; 248/642 --

FOREIGN PATENT DOCUMENTS, please add the following:

-- October 1996 (JP).....8-268385 --

Signed and Sealed this

Seventh Day of May, 2002

*Attest:*

*Attesting Officer*

JAMES E. ROGAN
*Director of the United States Patent and Trademark Office*